US009541035B2

(12) United States Patent
Polcyn et al.

(10) Patent No.: US 9,541,035 B2
(45) Date of Patent: Jan. 10, 2017

(54) EGR DEVICE HAVING SLIDABLE VALVE

(71) Applicants: DENSO International America, Inc., Southfield, MI (US); DENSO CORPORATION, Kariya, Aichi-pref. (JP)

(72) Inventors: Nicholas Polcyn, Commerce, MI (US); Jonathan Logan, Walled Lake, MI (US); Dallas Smolarek, Northville, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 277 days.

(21) Appl. No.: 14/561,373

(22) Filed: Dec. 5, 2014

(65) Prior Publication Data

US 2016/0160807 A1 Jun. 9, 2016

(51) Int. Cl.
*F02M 25/07* (2006.01)

(52) U.S. Cl.
CPC ..... *F02M 25/0793* (2013.01); *F02M 25/0715* (2013.01); *F02M 25/0794* (2013.01); *F02M 26/19* (2016.02); *F02M 26/06* (2016.02); *F02M 26/23* (2016.02)

(58) Field of Classification Search
CPC ..... F02M 26/06; F02M 26/19; F02M 26/21; F02M 26/23; F02M 26/65; F02M 26/68; F02M 26/70
See application file for complete search history.

(56) References Cited

U.S. PATENT DOCUMENTS

| | | | | |
|---|---|---|---|---|
| 5,718,211 | A * | 2/1998 | Halsall | F02M 26/68 123/568.11 |
| 7,472,886 | B2 * | 1/2009 | Shimane | F16K 1/2261 251/305 |
| 8,689,553 | B2 * | 4/2014 | Johnson | F02D 9/02 123/568.17 |
| 2007/0271920 | A1 | 11/2007 | Marsal et al. | |
| 2012/0180478 | A1 | 7/2012 | Johnson et al. | |

FOREIGN PATENT DOCUMENTS

| | | | | |
|---|---|---|---|---|
| EP | 0962646 | A1 * | 12/1999 | F02M 26/55 |
| WO | 2013-055361 | A1 | 4/2013 | |

* cited by examiner

*Primary Examiner* — Hieu T Vo

(57) ABSTRACT

An EGR device includes a housing and a valve. The housing has an outer pipe and an inner structure. The inner structure is located inside the outer pipe to define an annular passage externally with the outer pipe. The inner structure defines an inner passage internally. The inner structure has apertures. The valve is in a tubular shape and is located inside the inner structure. The valve is slidable in an axial direction to communicate the annular passage with the inner passage through the apertures and to block the inner passage from the annular passage.

20 Claims, 8 Drawing Sheets

EGR DEVICE HAVING SLIDABLE VALVE

TECHNICAL FIELD

The present disclosure relates to an EGR device having a slidable valve for an internal combustion engine of a vehicle.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh air to produce mixture gas containing recirculated exhaust gas and fresh air. Recirculated exhaust gas may be unevenly mixed with fresh air to reduce combustion efficiency of the engine consequently.

SUMMARY

The present disclosure addresses the above-described concerns.

According to an aspect of the preset disclosure, an EGR device comprises a housing having an outer pipe and an inner structure, the inner structure located inside the outer pipe to define an annular passage externally with the outer pipe, the inner structure defining an inner passage internally, the inner structure having a plurality of apertures. The EGR device further comprises a valve in a tubular shape and located inside the inner structure. The valve is slidable in an axial direction to communicate the annular passage with the inner passage through the apertures and to block the inner passage from the annular passage.

According to another aspect of the preset disclosure, an EGR device comprises a housing having an outer pipe and an inner structure, the inner structure located inside the outer pipe to define an annular passage externally with the outer pipe, the inner structure defining an inner passage internally, the inner structure having a plurality of apertures extending radially therethrough. The EGR device further comprises a valve in a tubular shape and located inside the inner structure. The valve is slidable in an axial direction to control an area of the apertures through which the annular passage communicates with the inner passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Embodiment

In the following description, a radial direction is along an arrow represented by "RADIAL" in drawing(s). An axial direction is along an arrow represented by "AXIAL" in drawing(s). A circumferential direction is along an arrow represented by "CIRCUMFERENTIAL" in drawing(s). A flow direction is along an arrow represented by "FLOW" in drawing(s).

Figure 1:
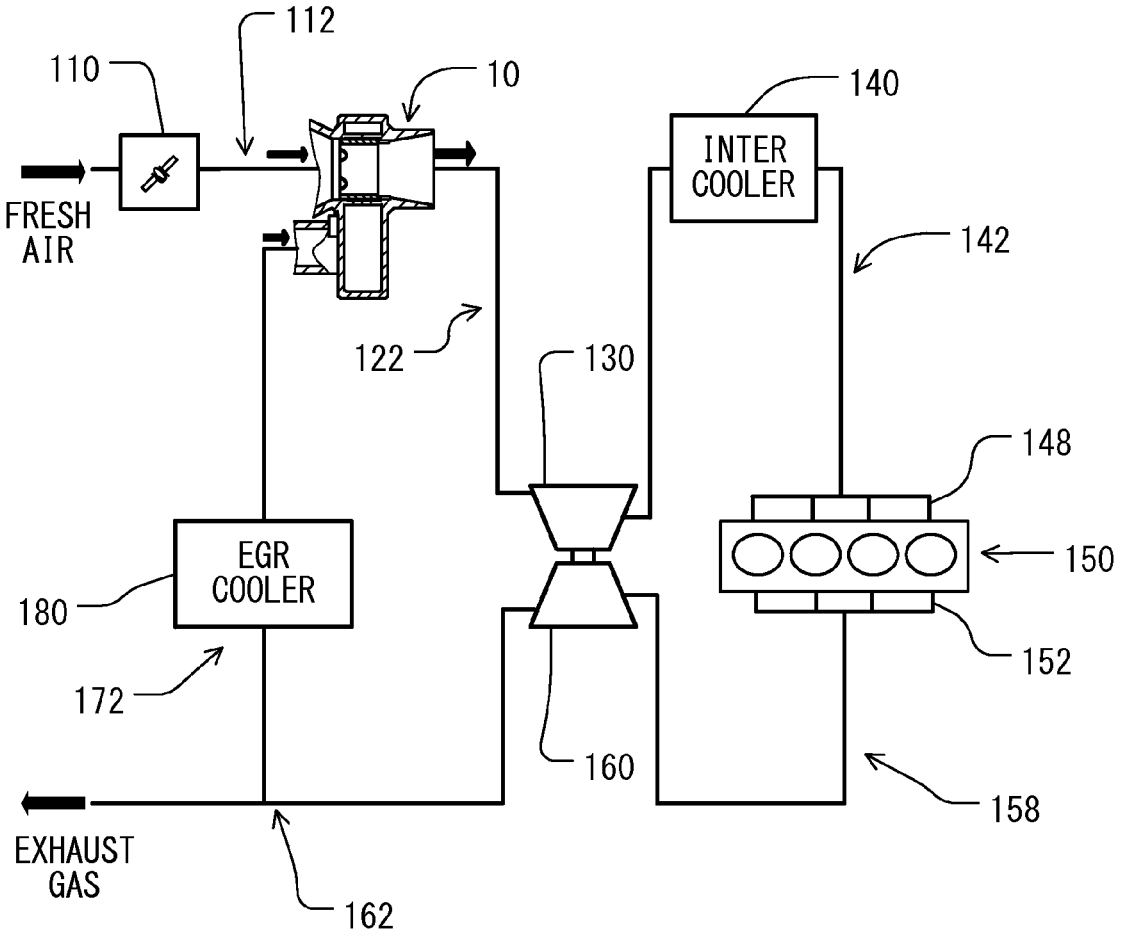
FIG. 1 is a block diagram showing an EGR system for an internal combustion engine of a vehicle.

As shown FIG. 1, according to the present example, an internal combustion engine 150 has four cylinders connected with an intake manifold 148 and an exhaust manifold 152.

The engine 150 is combined with an intake and exhaust system. The intake and exhaust system includes an intake valve 110, an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, and an EGR cooler 180.

The intake passage 112 is equipped with the intake valve 110. The intake passage 112 is connected with the EGR device 10. The EGR device 10 is connected with the compressor 130 through the mixture passage 122. The compressor 130 is connected with the intake manifold 148 through the charge air passage 142. The charge air passage 142 is equipped with the intercooler 140. The exhaust manifold 152 is connected with the turbine 160 through the combustion gas passage 158. The turbine 160 is connected with the exhaust passage 162. The EGR passage 172 is branched from the exhaust passage 162 and connected with the EGR device 10. The EGR passage 172 is equipped with the EGR cooler 180.

The intake passage 112 conducts fresh air from the outside of the vehicle through the intake valve 110 into the EGR device 10. The intake valve 110 regulates a quantity of fresh air flowing through the intake passage 112 into the EGR device 10. The EGR device 10 draws fresh air from the intake passage 112 and draws exhaust gas from the exhaust passage 162 through the EGR passage 172. The EGR device 10 includes an EGR mixer to blend the drawn fresh air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 152 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10.

As described above, the EGR system is configured to recirculate a part of exhaust gas from the exhaust passage 162 into the intake passage 112. The circulated exhaust gas may contain oxygen at a lower percentage compared with oxygen contained in fresh air. Therefore, circulated exhaust gas may dilute mixture of exhaust gas and fresh air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Subsequently, the configuration of the EGR device 10 will be described in detail. As shown in FIGS. 2 to 7, the EGR device 10 includes a housing 20 accommodating a valve (slidable valve) 60 and an actuator 94. The housing 20 and the valve 60 are formed of a metallic material such as stainless steel and/or an aluminum alloy.

The housing 20 includes an air inlet 22, an outer pipe 40, an inner structure 50, an outlet 26, an EGR inlet 28, and an EGR guide 32. The air inlet 22 is connected with the intake passage 112. The outlet 26 is connected with the mixture passage 122. The outer pipe 40 and the inner structure 50 are located between the air inlet 22 and the outlet 26.

The air inlet 22 has an inner periphery in a tapered shape. The air inlet 22 reduces in inner diameter from its upstream toward the inner structure 50. The outlet 26 has an inner periphery in a tapered shape. The outlet 26 increases in inner diameter from the inner structure 50 to its downstream. The air inlet 22, the inner structure 50, and the outlet 26 form a throttle to reduce a passage at the inner structure 50.

The inner structure 50 includes multiple frames 58 and multiple meshes 56. Each of the frames 58 extends along the axial direction and connects the air inlet 22 with the outlet 26. The frame 58 has a pin 58A projected from its inner periphery inward in the radial direction. The pin 58A may be, for example, in a chamfered dome shape. The frames 58, the air inlet 22, and the outlet 26 form hollow apertures 50A thereamong. The hollow apertures 50A are each substantially being in a rectangular shape. The hollow apertures 50A are filled with the meshes 56. Each of the meshes 56 extends along the axial direction and connects the air inlet 22 with the outlet 26. In addition, each of the meshes 56 extends in the circumferential direction to connect the frames 58, which are adjacent to each other in the circumferential direction. The frames 58 and the meshes 56 are alternately arranged in the circumferential direction to form a tubular structure. According to the present example, the inner structure 50 includes four frames 58 and four meshes 56, which are arranged substantially at angular intervals, such as 90-degree intervals. The frames 58 are opposed to the annular passage 48 in the radial direction.

As a whole, the inner structure 50 is in a tubular shape and is coaxial with the outer pipe 40. The inner structure 50 is located on the radially inside of the outer pipe 40. The frames 58 and the meshes 56 of the inner structure 50 form an outer periphery, which defines an annular passage 48 with an inner periphery of the outer pipe 40. The annular passage 48 extends in the circumferential direction.

The housing 20 forms an inner passage 52 communicated with the intake passage 112 and the mixture passage 122. The frames 58 and the meshes 56 of the inner structure 50 have an inner periphery forming a part of the inner passage 52. The mesh 56 may have various configurations to form multiple throttles in the hollow apertures 50A. The mesh 56 may form microscopic non-linear passages to enable EGR gas to flow from the annular passage 48 into the inner passage 52 therethrough. The non-linear passages of the mesh 56 may enable to deflect the EGR gas flow to generate turbulence. The mesh 56 is formed by, for example, knitting metallic wires to form multiple grids. The mesh 56 may have a three-dimensional structure to have grid structures alternately layered. The mesh 56 may be formed by perforating a metallic sheet. In this case, the metallic sheet may be stacked to form multiple layers to have zigzag microscopic passages. The mesh 56 is affixed to the housing 20 to form the inner structure 50 by, for example, welding and/or bonding.

The EGR inlet 28 is connected with the EGR passage 172. The EGR inlet 28 is communicated with an EGR channel 46 defined in the EGR guide 32. The EGR channel 46 is communicated with the annular passage 48.

The inner structure 50 accommodates the valve 60. The valve 60 is in a tubular shape and is slidable inside the inner structure 50. The valve 60 has four rails 68 on the outer periphery. Each of the rails 68 is a groove dented from the outer periphery of the valve 60 in the radial direction. The rail 68 extends along the axial direction.

Figure 7:
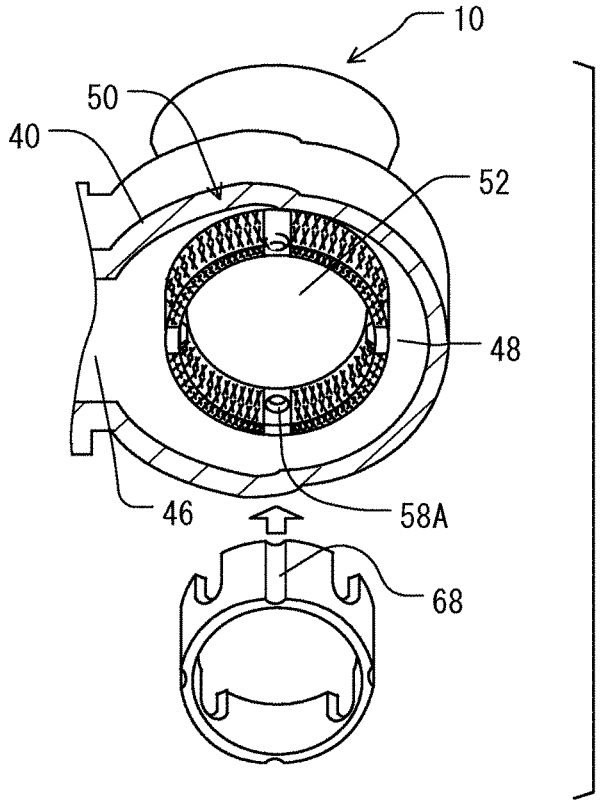
FIG. 7 is an exploded view showing a valve and an inner structure of the EGR device.
Figure 7:
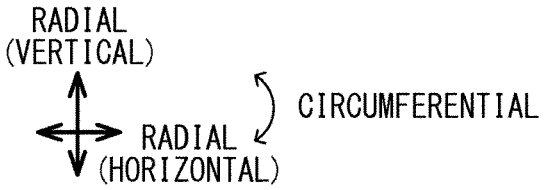

As shown in FIG. 7, according to the present example, the rails 68 of the valve 60 are fitted to the pins 58A of the frames 58, respectively. Thus, the valve 60 is guided by the pins 58A along the rails 68 and is movable in the axial direction.

Referring back to FIG. 2, the valve 60 has a valve end 62 (one end) in the axial direction, and the valve end 62 defines multiple notches 66. The notches 66 are arranged along the circumferential direction. According to the present example, the valve 60 has four notches 66, which are arranged substantially at angular intervals, such as 90-degree intervals. The four notches 66 are opposed to the four meshes 56, respectively, in the radial direction.

Each of the notches 66 is a hollow in a semicircular shape and extends through the tubular wall of the valve 60 along the radial direction. The notch 66 is directed substantially at 90 degrees relative to the center axis of the inner structure 50. The notch 66 is open on the side of the valve end 62.

An electronic control unit (ECU) 98 is electrically connected with the actuator 94 to control a driving power source such as electricity supplied to the actuator 94. In the present example, the valve 60 has an other end 64 in the axial direction, and the other end 64 is coupled with the actuator 94.

The actuator 94 is configured to extend and to contract in the axial direction to actuate the valve 60. The actuator 94 may employ various configurations to change its end position in the axial direction. For example, the actuator 94 may include one or a combination of a solenoid device, a hydraulic or pneumatic device, and/or the like. The actuator 94 may be equipped with an external device. In this case, the external device may, for example, supply a hydraulic or pneumatic source to the actuator 94 and/or may discharge the hydraulic or pneumatic source from the actuator 94.

Further, in this case, the ECU 98 may be connected with the external device to control the actuator 94. The actuator 94 may be combined with a resilient device such as a coil spring and/or an elastic-material member. In this case, the resilient device may be equipped to the valve end 62 and/or to the other end 64 of the valve 60. The actuator 94 and/or the valve 60 may be equipped with a detection device such as a potentiometer to detect the position of the valve 60 in the axial direction.

The ECU 98 controls the actuator 94 to expand and to contract thereby to push and pull the valve 60 along the axial direction. Thus, in the drawing, the valve 60 is slidable rightward in an opening direction toward a full open position. In addition, the valve 60 is slidable leftward in a closing direction toward a full close position. The valve 60 is configured to be located at an intermediate position between the full open position and the full close position.

Figure 2:
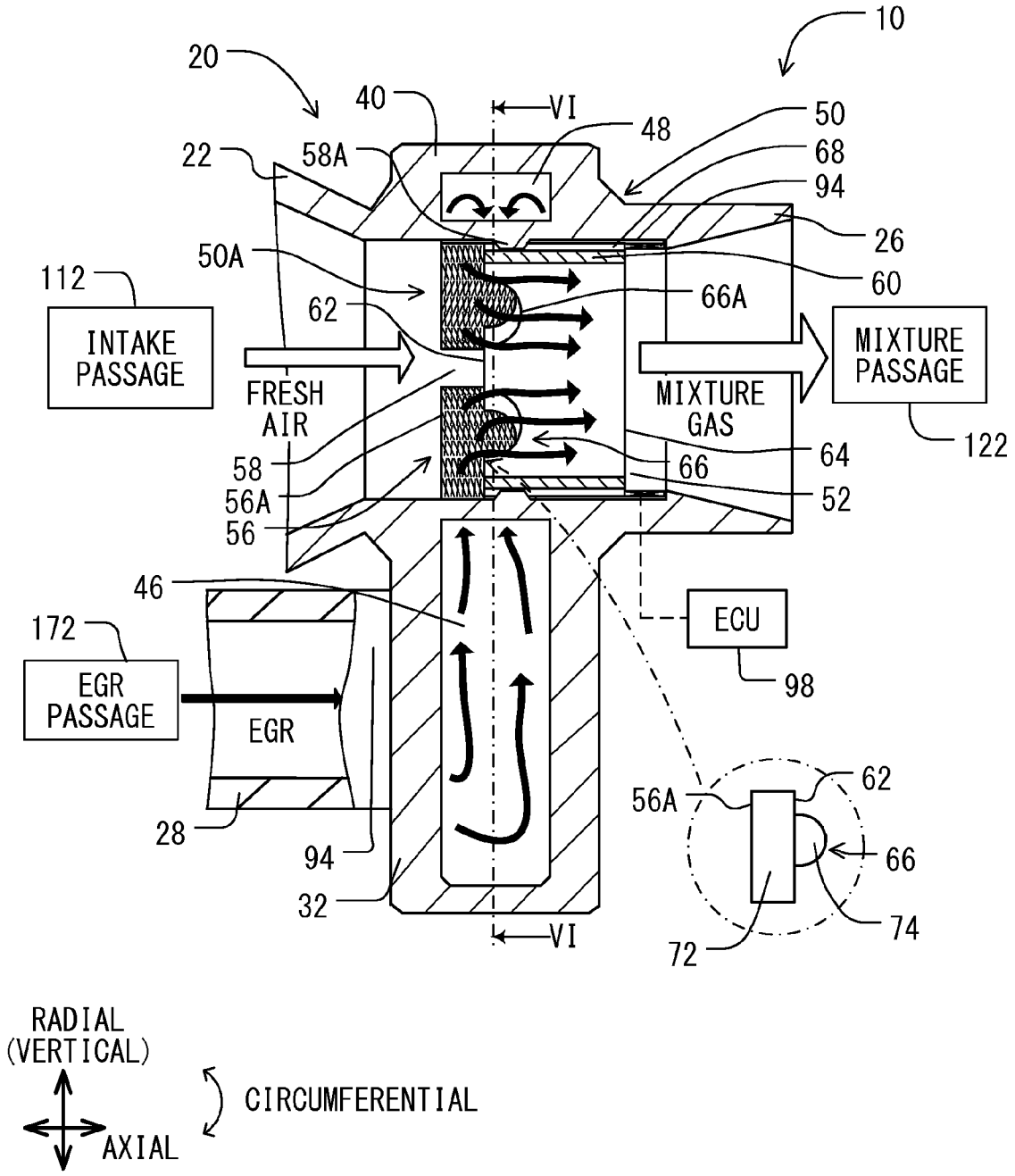
FIG. 2 is a sectional view showing an EGR device for the EGR system at a full open position, according to an embodiment.

In FIG. 2, the valve 60 is at the full open position where the valve 60 is at the rightmost position in the drawing. In the present full open position, the actuator 94 is in its minimum length in the axial direction. In the present state, the valve end 62 is away from a mesh end 56A of the mesh 56 rightward in the opening direction. Thus, as shown in the dashed circle in FIG. 2, the valve 60 and the inner structure 50 form passages each including a rectangular passage (main-passage) 72 and a notch passage (sub-passage) 74. The rectangular passage 72 is defined between the valve end 62 and the mesh end 56A. The notch passage 74 is defined within the notch 66. The inner passage 52 is opposed to the annular passage 48 in the radial direction through both the rectangular passage 72 and the notch passage 74. Thus, the inner passage 52 is communicated with the annular passage 48 through a communication passage including both the rectangular passage 72 and the notch passage 74. In the present state, the valve 60 widely opens the communication passage to communicate the inner passage 52 with the annular passage 48 through both the rectangular passage 72 and the notch passage 74.

Figure 6:
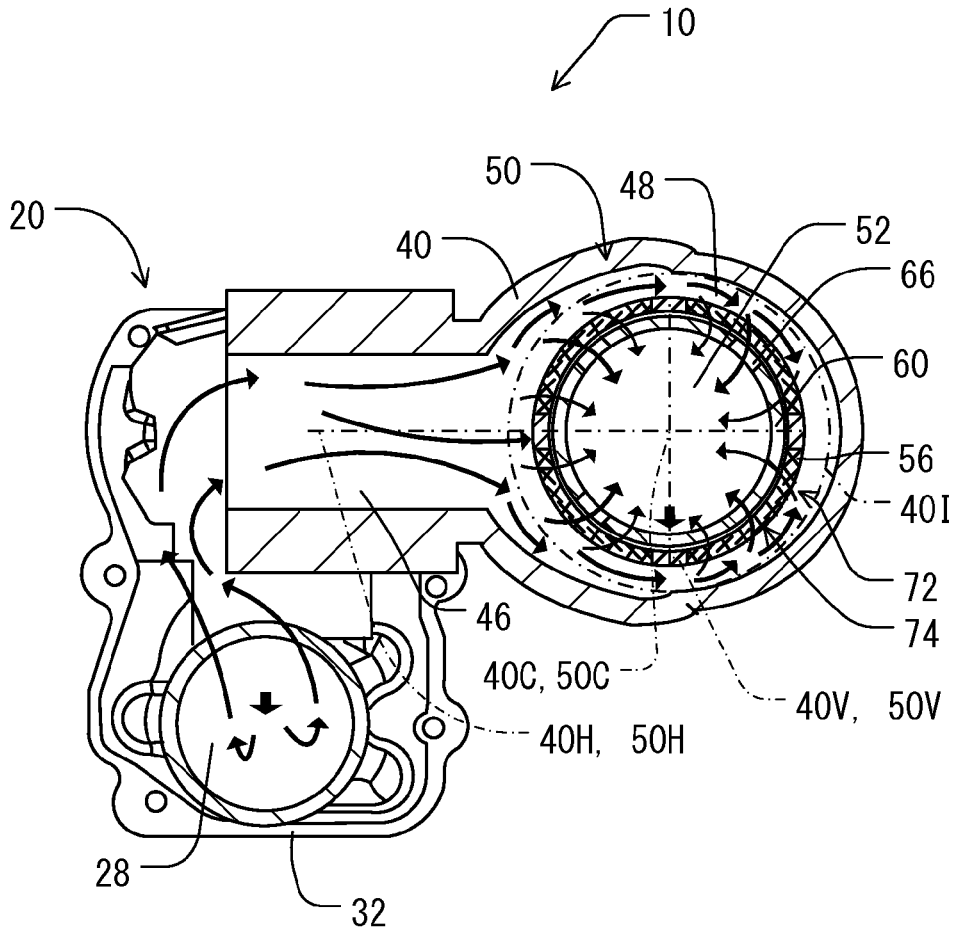
FIG. 6 is a sectional view showing the EGR device, the sectional view corresponding to a section taken along the line VI-VI in FIG. 2.
Figure 6:
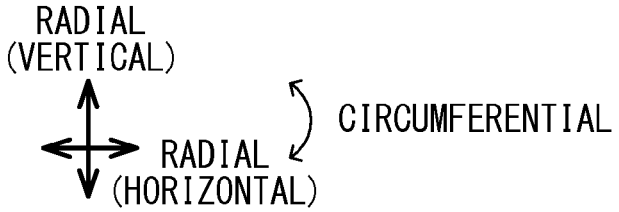

As shown in FIG. 6, at the present full open position, the EGR device 10 enables to flow EGR gas from the EGR inlet 28 through the EGR channel 46. The EGR device 10 enables to flow the EGR gas further to pass through the annular passage 48 into the inner passage 52 radially inward through the rectangular passages 72 and the notch passages 74.

Referring back to FIG. 2, the valve 60 is movable leftward in the closing direction to decrease the communication between the annular passage 48 and the inner passage 52. The valve 60 has the valve end 62 on the left side in the closing direction. The meshes 56 have mesh ends 56A, respectively, on the left side in the closing direction. The valve end 62, the mesh ends 56A, and the notches 66 define the communication passage including the rectangular passages 72 and the notch passages 74.

As the valve 60 moves leftward in the closing direction, the valve end 62 approaches the mesh ends 56A to reduce the rectangular passages 72. In this way, the valve 60 controls the areas of the rectangular passages 72.

When the valve end 62 is on an opening side (right side) from the mesh end 56A, the rectangular passages 72 appear to enable EGR gas to flow therethrough. In the present state, the valve 60 is in a large-passage control range, in which the valve 60 is enabled to control the EGR gas flow in a relatively large quantity to pass through both the rectangular passages 72 and the notch passages 74.

Figure 3:
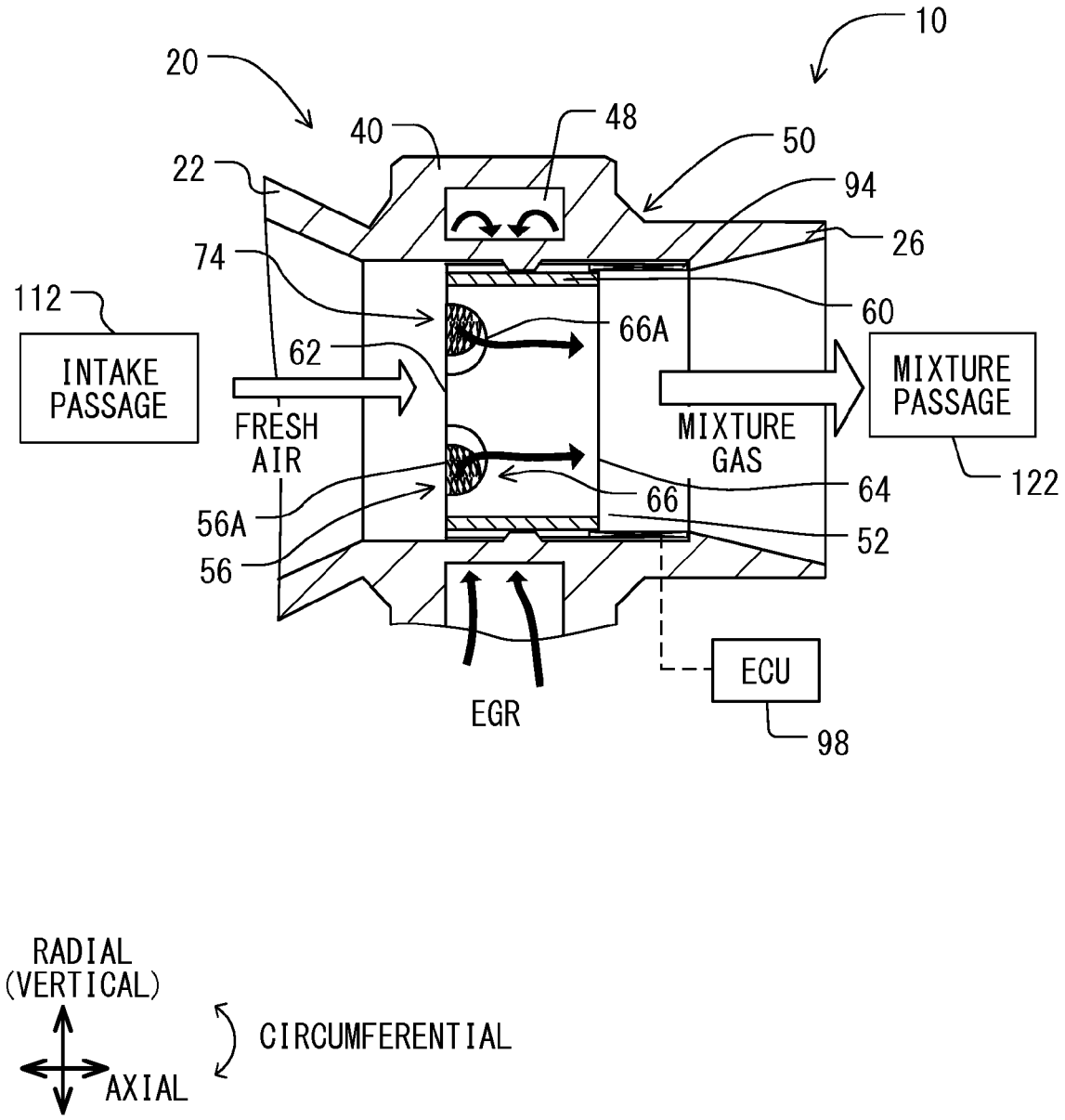
FIG. 3 is a sectional view showing the EGR device in a small-passage control range.
Figure 4:
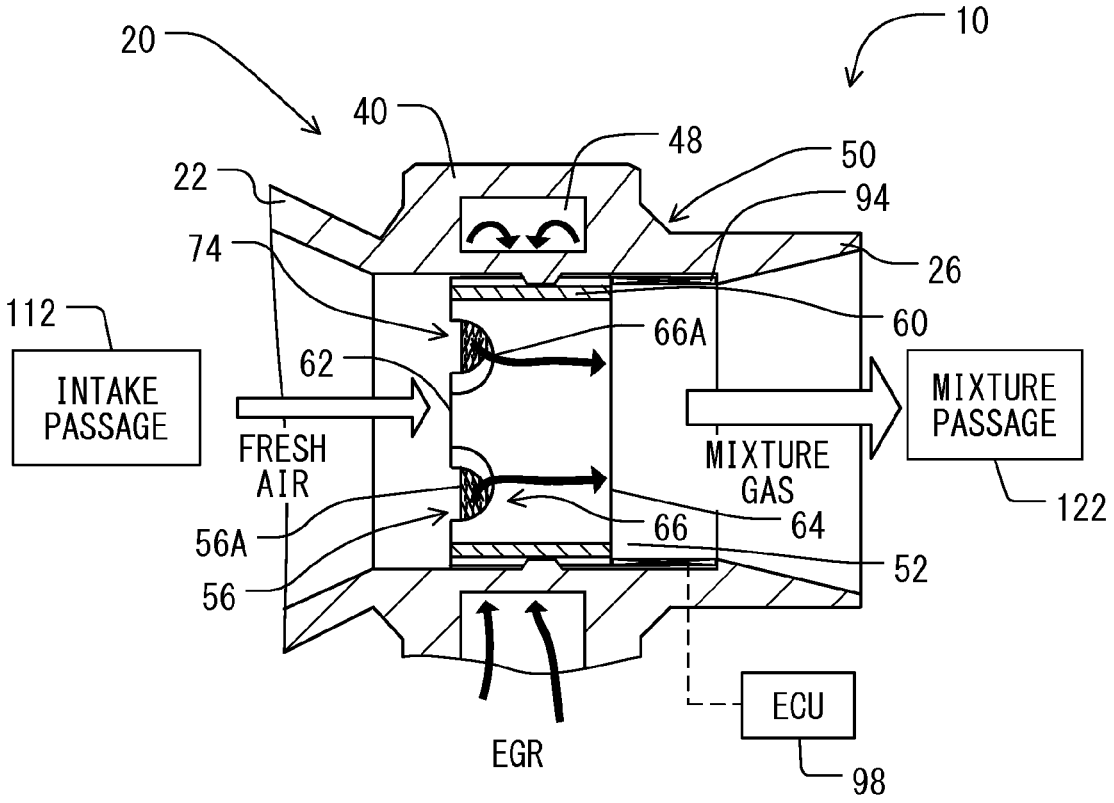
FIG. 4 is a sectional view showing the EGR device in the small-passage control range.
Figure 4:
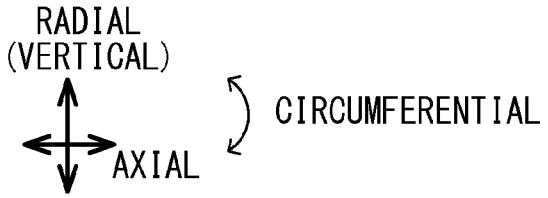
Figure 5:
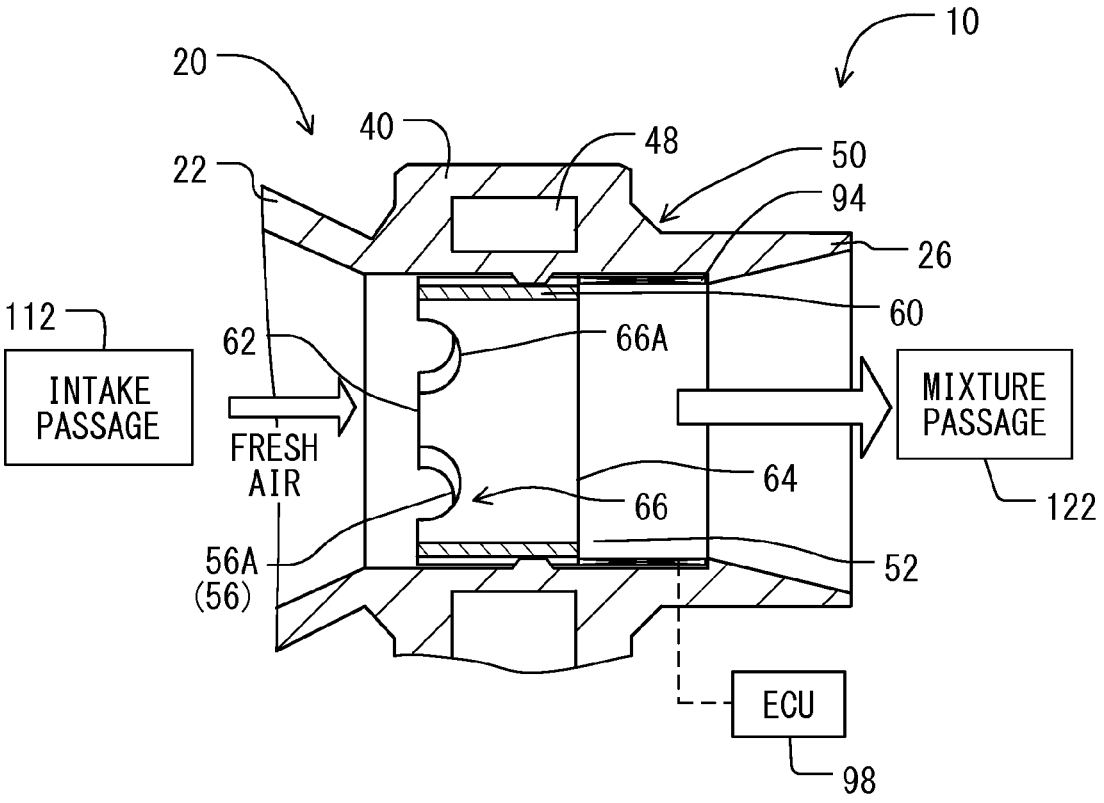
FIG. 5 is a sectional view showing the EGR device at a full close position.
Figure 5:
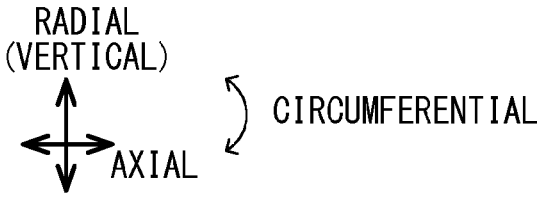

To the contrary, FIGS. 3 to 5 show states, in which the actuator 94 actuates the valve 60 to locate the valve end 62 on the mesh end 56A (FIG. 3) or to locate the valve end 62 beyond the mesh ends 56A on the closing side (left side) from the mesh ends 56A (FIGS. 4 and 5). In the present states, the tubular wall of the valve 60 totally covers the rectangular passages 72, and the rectangular passages 72 do not appear. Thus, EGR gas is prohibited from flowing through the rectangular passages 72. Presently, the valve 60 is in a small-passage control range, in which the valve 60 is enabled to control the EGR gas flow in a relatively small quantity to pass through the notch passages 74 defined within the notches 66.

FIG. 3 shows the valve 60 in the beginning (or end) of the small-passage control range. Presently, the actuator 94 is extended to locate the valve end 62 on the mesh ends 56A. Thus, the notch passages 74 entirely open through the notches 66.

FIG. 4 shows the valve 60 moved leftward in the closing direction from the state in FIG. 3. Presently, the actuator 94 is further extended to locate the valve end 62 beyond the mesh ends 56A on the closing side (left side). Thus, the notches 66 overlap the mesh ends 56A, and the tubular wall of the valve 60 further covers the meshes 56 to reduce the notch passages 74.

FIG. 5 shows the valve 60 moved leftward further in the closing direction from the state in FIG. 4. Presently, the actuator 94 is further extended to locate notch ends 66A of the notches 66 on the mesh ends 56A or to locate the notch ends 66A beyond the mesh ends 56A on the closing side (left side). Thus, the tubular wall of the valve 60 entirely covers the meshes 56 to close the notch passages 74. Presently, the valve 60 is in the end of the small-passage control range and is at the full close position. In the present state, the valve 60 blocks the inner passage 52 from the annular passage 48.

When the valve 60 is in the small-passage control range, the notches 66 are partially overlapped with the meshes 56 respectively and are partially overlapped with the inner periphery of the inner passage 52 formed in the housing 20. Thus, the valve 60 enables EGR gas to flow from the annular passage 48 into the inner passage 52 radially inward through the notch passages 74, which are overlapped areas between the meshes 56 and the notches 66.

As described above, the actuator 94 is configured to extend to move the valve 60 in the closing direction from the full open position toward the full close position through the large-passage control range and the small-passage control range. In addition, the actuator 94 is configured to contract to move the valve 60 in the opening direction from the full close position toward the full open position through the small-passage control range and the large-passage control range.

The ECU 98 may determine manipulation of the actuator 94 according to, for example, an operation state of the engine 150. The ECU 98 may determine to manipulate the actuator 94 to control the valve 60 within the large-passage control range when a large quantity of EGR gas is required. The large-passage control range may be employed in a case where, for example, the engine load is high. Consequently, the inner passage 52 is communicated with the annular passage 48 through the large area including both the rectangular passages 72 and the notch passages 74. Thus, the valve 60 is enabled to control a large quantity of EGR gas flow. To the contrary, the ECU 98 may determine to manipulate the actuator 94 to control the valve 60 within the small-passage control range when a small quantity of EGR gas is required. The small-passage control range may be employed in a case where, for example, the engine load is low. Consequently, the inner passage 52 is communicated with the annular passage 48 through the small area including the notch passages 74. Thus, the valve 60 is enabled to control EGR gas flow in a small quantity. In this case, the valve 60 is enabled to manipulate the overlapped areas between the notches 66 and the meshes 56. In the small-passage control range, a control gain of EGR gas flow relative to movement of the valve 60 may be small, thereby to enable to control a small quantity of EGR gas flow precisely.

As described above, the present configuration enables a two-step control including the large-passage control range and the small-passage control range with a simple structure.

Referring back to FIG. 6, the valve 60 is at the full open position corresponding to FIG. 2. In FIG. 6, the EGR device 10 enables to flow EGR gas from the EGR passage 172 to flow through the annular passage 48 circumferentially. The annular passage 48 leads EGR gas to flow from the EGR channel 46 and to flow entirely around the outer periphery of the inner structure 50 toward the opposite side of the EGR channel 46. Thus, the annular passage 48 may enable to distribute EGR gas evenly around the inner structure 50 in the circumferential direction.

In FIG. 6, the inner structure 50 has a cross section having a vertical center 50V, a horizontal center 50H, and a center point 50C, which is an intersection between the vertical center 50V and the horizontal center 50H. The inner periphery of the outer pipe 40 has a cross section defining an inscribe circle 40I, which has a vertical center 40V, a horizontal center 40H, and a center point 40C, which is an intersection between the vertical center 40V and the horizontal center 40H. In the present example, the inner structure 50 and the outer pipe 40 are substantially coaxial with each other. Specifically, the center point 50C of the inner structure 50 and the center point 40C of the inscribe circle 401 of the outer pipe 40 substantially coincide with each other.

The air inlet 22, the inner structure 50, and the outlet 26 form the throttle to cause Venturi effect at the valve 60. Thus, the configuration may facilitate to induce EGR gas from the annular passage 48 into the inner passage 52 through the meshes 56 and the notches 66 and to blend the EGR gas with fresh air.

The notch 66 forms a semicircular passage extending radially inward from the annular passage 48 toward the inner passage 52. The semicircular passage may throttle EGR gas flow to diffuse EGR gas into fresh air passing through the inner passage 52.

(Modification)

The notches 66 of the valve 60 may employ various forms. For example, the notches 66 may employ various numbers, various sizes, various arrangements, and/or various shapes. For example, the notches 66 may employ various shapes such as an oval shape or a polygonal shape. Various combinations of the notches 66 of the above-described embodiments may be arbitrary employed.

Figure 8A:
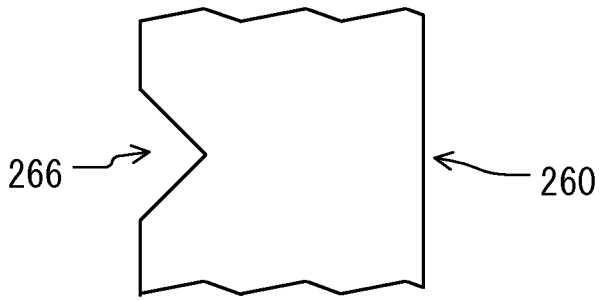
FIGS. 8A, 8B, and 8C are schematic views each showing a notch portion of a valve according to modifications.

FIG. 8A shows an example of a valve 260 having a notch 266 in a triangular shape. The notch 266 may have a different characteristic from that of the notch 66 in a semicircular shape as described in the first embodiment.

Figure 8B:
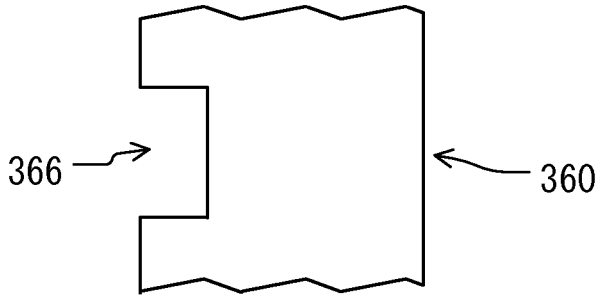

FIG. 8B shows an example of a valve 360 having a notch 366 in a rectangular shape. The notch 366 may produce a flow characteristic, which is linear relative to the axial position of the valve 360.

Figure 8C:
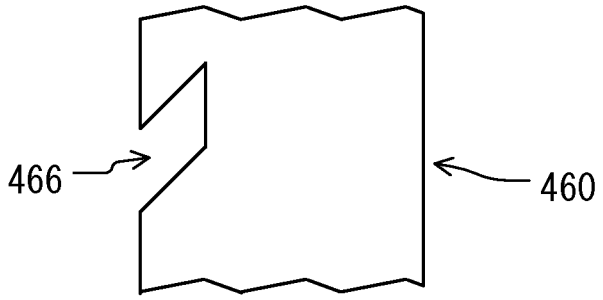

FIG. 8C shows an example of a valve 460 having a notch 466 in a parallelogram shape inclined in the circumferential direction toward the downstream side. The notch 466 may also produce a flow characteristic, which is linear relative to the axial position of the valve 460. In addition, the notch 466 may produce a spiral flow circumferentially toward the downstream thereby possibly to enhance homogeneously blending of fresh air and EGR gas to produce uniform mixture gas.

Other Embodiment

Various combinations of the valve, the inner structure, and other components of the EGR device according to the above-described embodiments may be arbitrary employed.

The notches may be unevenly arranged. For example, the notches may be concentrically formed on the opposite side of the EGR channel.

The notches may have different diameters. For example, notches may be formed to have diameters increased from the side of the EGR channel toward the opposite side of the EGR channel.

The notch(es) on the side of the EGR channel may be omitted. The number of the notches and/or the meshes on the upstream side of EGR gas flow may be smaller than the number of the notches and the meshes on the downstream side of EGR gas flow.

The notch may decrease in cross section in the radial direction. In this way, the notch may increase a velocity of EGR gas flow radially inward. The notch may increase in cross section in the radial direction.

The inner structure and the valve may be offset relative to the outer pipe, such that the vertical center of the outer pipe is offset from the vertical center of the inner structure in the radial direction. More specifically, the outer pipe and the inner structure may be offset in relation to each other so that a distance between the outer pipe and the inner structure progressively decreases from the EGR channel to the opposite side of the EGR channel. In this case, an annular passage 48 formed between the outer pipe and the inner structure may be gradually reduced in passage area toward the opposite side of the EGR channel.

The opening direction and the closing direction of the valve may be opposite from those in the above-described examples.

The mesh may be formed of various materials such as a resin material. The mesh may be adhered to the housing.

The density of the meshes may be unevenly set. For example, the meshes may be fine on the side of the EGR channel and may be coarse on the opposite side of the EGR channel.

The meshes may be omitted. In this case, the apertures may define hollow passages. The notches may be omitted. In this case, the valve may have a flat end.

The actuator and or the resilient device may be equipped to the valve end or may be equipped to both the valve end and the other end.

At least one of the air inlet and the outlet may not define the inclined passage and may define a straight passage.

The full open position of the valve in FIG. 2 is one example. When the valve is at the full open position, the annular passage may be totally in communication with the inner passages at entire width in the axial direction.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing having an outer pipe and an inner structure, the inner structure located inside the outer pipe to define an annular passage externally with the outer pipe, the inner structure defining an inner passage internally, the inner structure having a plurality of apertures; and a valve in a tubular shape and located inside the inner structure, wherein the valve is slidable in an axial direction to communicate the annular passage with the inner passage through the apertures and to block the inner passage from the annular passage.

2. The EGR device according to claim 1, further comprising:

a plurality of meshes filling the apertures, respectively.

3. The EGR device according to claim 2, wherein the valve has a plurality of notches, wherein at least one of the notches is configured to overlap with at least one of the meshes radially, and the valve is slidable to enable communication between the annular passage and the inner passage through at least one of the notches.

4. The EGR device according to claim 3, wherein the inner structure includes a plurality of frames extending in the axial direction, the frames are circumferentially arranged to form the apertures therebetween, and the frames are opposed to the annular passage in the radial direction.

5. The EGR device according to claim 4, wherein the frames are fitted to the valve to support the valve.

6. The EGR device according to claim 5, wherein the frames are equipped with pins, respectively, the valve has an outer periphery defining a plurality of rails, and the pins are fitted to the rails.

7. The EGR device according to claim 3, wherein the valve is movable in an opening direction to increase communication between the annular passage and the inner passage and is movable in a closing direction to decrease the communication, the valve has a valve end on a side in the closing direction, at least one of the meshes has a mesh end on a side in the closing direction, and the valve end, the mesh end, and at least one of the notches define a communication passage regulating the communication.

8. The EGR device according to claim 7, wherein when the valve is in a large-passage control region, the valve end is away from the mesh end in the opening direction to form the communication passage including both a main-passage and a sub-passage, the main-passage is defined between the valve end and the mesh end, and the sub-passage is defined within at least one of the notches.

9. The EGR device according to claim 8, wherein when the valve is in a small-passage control region, the valve end is on the mesh end or away from the mesh end in the closing direction to form the communication passage including the sub-passage.

10. The EGR device according to claim 9, wherein when the valve is in the small-passage control region, at least one of the notches is partially overlapped with the mesh end and is partially overlapped with an inner periphery of the housing to form an overlapped area therebetween to define the sub-passage.

11. The EGR device according to claim 10, wherein when the valve is in the small-passage control region, the sub-passage increases in size as the valve moves in the opening direction, and the sub-passage decreases in size as the valve moves in the closing direction.

12. The EGR device according to claim 11, wherein when a notch end of at least one of the notches is on the mesh end or away from the mesh end in the closing direction, the at least one of the notches are entirely overlapped with the inner periphery of the housing, and the valve is at a full close position.

13. The EGR device according to claim 12, wherein the valve is movable in the opening direction from the full close position through the small-passage control region and the large-passage control region to a full open position, and the valve is movable in the closing direction from the full open position through the large-passage control region and the small-passage control region to the full close position.

14. The EGR device according to claim 3, wherein at least one of the notches is in one of a semicircular shape, a triangular shape, a rectangular shape, and a parallelogram shape.

15. The EGR device according to claim 1, wherein the valve is located radially inside the inner structure, and the valve is coaxial with the inner structure.

16. The EGR device according to claim 1, wherein the inner structure is offset from the outer pipe.

17. The EGR device according to claim 3, wherein at least one of the notches on an upstream side is smaller than at least one of an other of the notches on a downstream side.

18. The EGR device according to claim 3, wherein a number of the notches on an upstream side is smaller than a number of the notches on a downstream side.

19. The EGR device according to claim 2, wherein at least one of the meshes form a plurality of non-linear passages therein.

20. An EGR device comprising:

a housing having an outer pipe and an inner structure, the inner structure located inside the outer pipe to define an annular passage externally with the outer pipe, the inner structure defining an inner passage internally, the inner structure having a plurality of apertures extending radially therethrough; and a valve in a tubular shape and located inside the inner structure, wherein the valve is slidable in an axial direction to control an area of the apertures through which the annular passage communicates with the inner passage.

* * * * *